US012703462B2

(12) United States Patent
Westrick et al.

(10) Patent No.: US 12,703,462 B2
(45) Date of Patent: Aug. 11, 2026

(54) PONTOON WATERCRAFT WITH ELECTRICAL PROPULSION

(71) Applicant: Hyper Electric Marine Inc., Huntertown, IN (US)

(72) Inventors: Michael D. Westrick, Huntertown, IN (US); Kaleb J. Reinhart, Huntertown, IN (US); Griff Suelzer, Coldwater, MI (US); Steven V. Werling, Hudson, IN (US); Matthew R. Williams, Fort Wayne, IN (US)

(73) Assignee: Hyper Electric Marine Inc., Huntertown, IN (US)

( * ) Notice: Subject to any disclaimer, the term of this patent is extended or adjusted under 35 U.S.C. 154(b) by 384 days.

(21) Appl. No.: 18/446,089

(22) Filed: Aug. 8, 2023

(65) Prior Publication Data

US 2025/0050982 A1 Feb. 13, 2025

(51) Int. Cl.

| | |
|---|---|
| ***B63B 35/38*** | (2006.01) |
| ***B63B 1/12*** | (2006.01) |
| ***B63B 3/48*** | (2006.01) |
| ***B63B 11/00*** | (2006.01) |
| ***B63B 43/00*** | (2006.01) |
| ***B63H 11/08*** | (2006.01) |
| ***B63H 21/17*** | (2006.01) |
| ***B63H 25/38*** | (2006.01) |

(52) U.S. Cl.

CPC ..... *B63B 35/38* (2013.01); *B63B 1/125* (2013.01); *B63B 3/48* (2013.01); *B63B 11/00* (2013.01); *B63B 43/00* (2013.01); *B63H 11/08* (2013.01); *B63H 21/17* (2013.01); *B63H 25/38* (2013.01)

(58) Field of Classification Search

CPC ..... B63B 35/38; B63B 1/125; B63B 3/48

See application file for complete search history.

(56) References Cited

U.S. PATENT DOCUMENTS

| | | | | |
|---|---|---|---|---|
| 3,289,226 | A | 12/1966 | Thompson | |
| 3,347,201 | A | 10/1967 | Szabo | |
| 3,659,546 | A | 5/1972 | Miklos | |
| 3,815,541 | A | 6/1974 | Hansen | |
| 4,051,801 | A | 10/1977 | Woodfill et al. | |
| 5,184,561 | A | 2/1993 | Nickell, Jr. | |
| 5,259,331 | A * | 11/1993 | Hagan | B63H 5/16 114/61.1 |
| 5,435,260 | A | 7/1995 | Granie et al. | |
| 5,590,616 | A * | 1/1997 | Vera | B63B 35/36 114/361 |
| 5,759,074 | A | 6/1998 | Jones | |
| 5,879,209 | A | 3/1999 | Jones | |
| 5,911,187 | A * | 6/1999 | Sohm | B63B 1/12 114/283 |

(Continued)

FOREIGN PATENT DOCUMENTS

| | | | | |
|---|---|---|---|---|
| CA | 3222579 A1 * | 6/2024 | ..... | B63B 1/125 |
| WO | WO-2022152887 A1 * | 7/2022 | ..... | B63B 21/10 |

*Primary Examiner* — Marc Q Jimenez
*Assistant Examiner* — Jovon E Hayes
(74) *Attorney, Agent, or Firm* — TAYLOR & EDELSTEIN, PC

(57) ABSTRACT

A watercraft includes: a deck; and a first pontoon coupled with the deck, the first pontoon including: a first body; a first marine propulsion device coupled with the first body; and a first electric motor operably coupled with the first marine propulsion device and disposed within the first body.

17 Claims, 12 Drawing Sheets

(56) References Cited

U.S. PATENT DOCUMENTS

| | | | | |
|---|---|---|---|---|
| D416,852 | S | 11/1999 | Clarke | |
| 6,016,762 | A * | 1/2000 | Price | B63B 1/18 114/274 |
| 6,454,620 | B1 | 9/2002 | Theisen et al. | |
| 6,477,969 | B2 | 11/2002 | Schell-Tomczak et al. | |
| 6,482,056 | B1 * | 11/2002 | Schell-Tomczak | B63H 20/06 248/641 |
| 6,708,642 | B1 * | 3/2004 | Taylor | B63B 1/285 114/291 |
| 6,939,184 | B2 * | 9/2005 | Fishburn | B63B 3/48 114/61.1 |
| 7,185,599 | B1 * | 3/2007 | Griffiths | B63B 1/12 114/263 |
| 11,420,715 | B1 * | 8/2022 | Simard | B63B 13/02 |
| 2004/0255836 | A1 | 12/2004 | Hopkins | |
| 2020/0255110 | A1 * | 8/2020 | Doremus | B63B 1/125 |
| 2021/0094665 | A1 * | 4/2021 | Schmid | B63B 1/125 |
| 2022/0250717 | A1 * | 8/2022 | Kalil | B63B 3/48 |
| 2022/0348300 | A1 * | 11/2022 | Weber | B63H 11/08 |
| 2023/0049367 | A1 * | 2/2023 | Endrizzi | B63H 25/42 |
| 2023/0249795 | A1 * | 8/2023 | Breyer | B63H 21/17 440/6 |

* cited by examiner

PONTOON WATERCRAFT WITH ELECTRICAL PROPULSION

BACKGROUND OF THE INVENTION

1. Field of the Invention

The present invention relates to watercraft, and, more particularly, to pontoon watercraft.

2. Description of the Related Art

Some watercraft (which can also be referred to herein as boats) are pontoon watercraft. Pontoon watercraft include two or more pontoons (which can also be referred to as toons) as floatation or buoyancy devices. Pontoon watercraft that include three pontoons can optionally be referred to as tritoons. Pontoons are typically tubes (which can be referred to as floatation tubes) that are airtight and hollow, and they are made of known materials. Pontoons are typically hollow or foam-filled tubes that are arranged in a generally parallel relation with each other. Pontoon watercraft can further include a deck (which can also be referred to as a platform) which extends across upper portions of the pontoons. In many applications, a majority of a surface of the deck is a flat horizontal plane.

In a typical application, a pontoon watercraft includes an outboard motor that is attached to a rear portion of a support structure of the vessel. In some applications, the outboard motor can be provided with a jet pump attached to a lower portion of a driveshaft housing of the outboard motor. In other applications, not involving a jet pump, the outboard motor is typically provided with a conventional propeller that is supported for rotation by a gear case located at a bottom portion of the driveshaft housing. In jet pump applications, the gear case is replaced with a jet pump having an impeller.

Those skilled in the art of marine propulsion systems used in conjunction with pontoon boats are familiar with a detachable center pontoon, or enclosure, that can be fastened beneath the deck of the pontoon boat and provided with an inboard marine drive. In addition, certain applications of removably attachable center pontoons used with pontoon boats can incorporate a sterndrive propulsion device.

In known applications, a portion of the marine propulsion system, such as the engine, extends upwardly through the plane of the upper surface of the deck of the pontoon watercraft. However, known marine propulsion devices of the type described above do not provide a sterndrive, jet drive propulsion, or a direct drive device within a center pontoon that permits the entire motor and drive to be disposed completely below the upper surface of the deck that extends between flotation tubes.

What is needed in the art is a pontoon watercraft propelled by an electric motor that does not use up deck space of the watercraft.

SUMMARY OF THE INVENTION

The present invention provides a watercraft including a pontoon that includes an electric motor disposed within the pontoon.

The invention in one form is directed to a watercraft, including: a deck; and a first pontoon coupled with the deck, the first pontoon including: a first body; a first marine propulsion device coupled with the first body; and a first electric motor operably coupled with the first marine propulsion device and disposed within the first body.

The invention in another form is directed to a pontoon of a watercraft, the watercraft including a deck with which the pontoon is coupled, the pontoon including: a body; a marine propulsion device coupled with the body; and an electric motor operably coupled with the marine propulsion device and disposed within the body.

The invention in yet another form is directed to a method using a watercraft, the method including the steps of: providing that the watercraft includes a deck and a first pontoon coupled with the deck, the first pontoon including a first body; coupling a first marine propulsion device with the first body; coupling operably a first electric motor with the first marine propulsion device; and disposing the first electric motor within the first body.

An advantage of the present invention is the pontoon watercraft can be powered by an electric motor that is not mounted atop the deck of the watercraft but is mounted below the deck in a pontoon, with the result that the electric motor takes up less deck space.

Another advantage of the present invention is that an energy storage device of the pontoon watercraft, such as one or more batteries, can also be mounted in the pontoon, with the result that the energy storage device takes up less deck space.

Yet another advantage of the present invention is that the pontoon carrying the electrical motor and the energy storage device can be detached and attached to the bottom of the deck, for example for maintenance and/or repairs.

Yet another advantage of the present invention is that the pontoon carrying the electric motor and energy storage device can be retrofitted to an existing pontoon watercraft (such that an existing pontoon can be removed and replaced with the pontoon carrying the electric motor and energy storage device) or can be added to a pontoon watercraft such that the pontoon no longer has only two pontoons but now has three pontoons, with the pontoon carrying the electric motor and energy storage device being a center pontoon.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
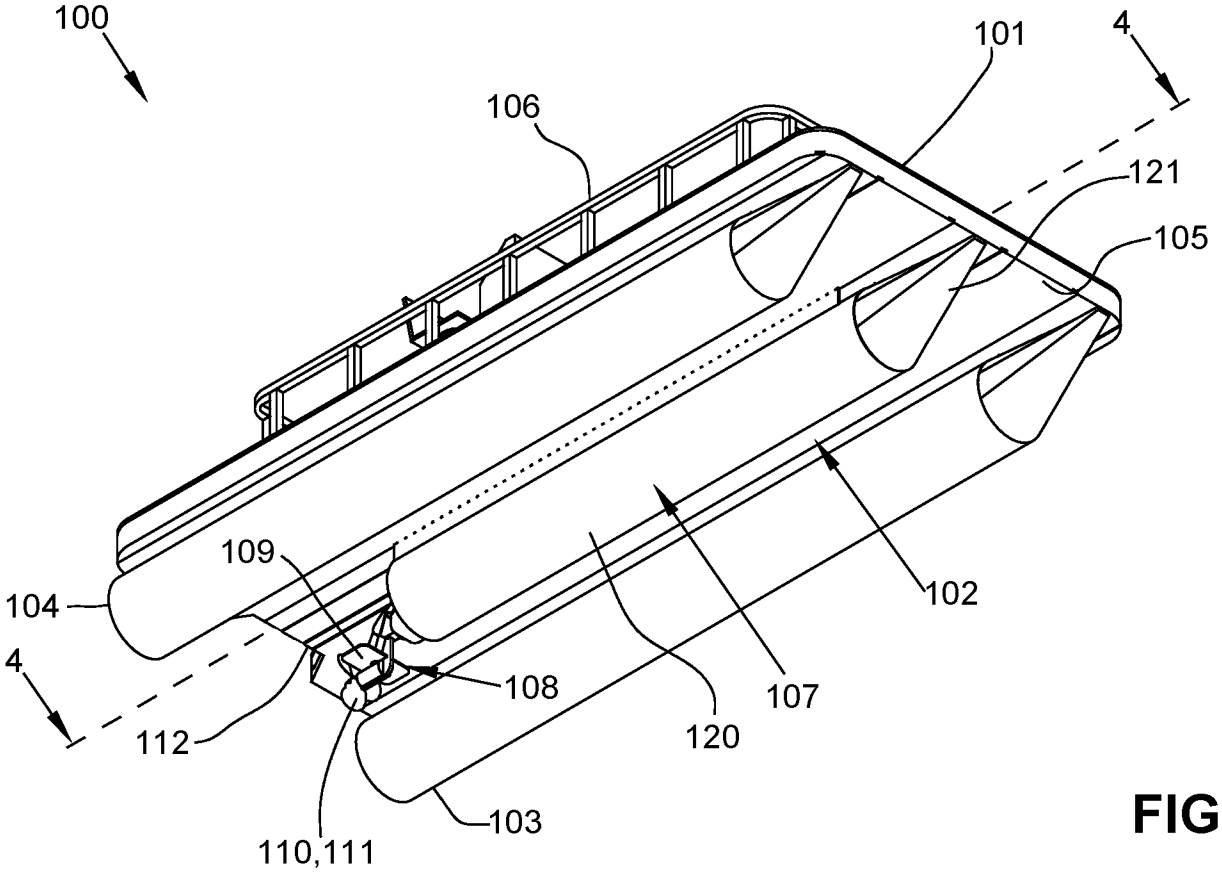
FIG. 1 illustrates a bottom perspective view of a watercraft, the watercraft including a deck and a center pontoon, in accordance with an exemplary embodiment of the present invention.

Referring now to the drawings, and more particularly to FIG. 1, there is shown a bottom perspective view of a watercraft 100 which generally includes a deck 101 and a plurality of pontoons 102, 103, 104 coupled with deck 101, more specifically, to an underside 105 of deck 101. Deck 101 can be a chassis of watercraft 100, or can include the chassis of watercraft 100 (deck 101 can also be referred to as a platform). Mounted to deck 101 is a railing 106 of watercraft 100 (railing 106 is attached to deck 101 in known manner). Further, deck 101, according to one embodiment, has a top or upper surface that is a flat plane in an entire region directly above pontoon 102. Pontoons 103, 104 are laterally positioned, such that pontoon 103 is positioned on a port side of watercraft 100, and pontoon 104 is positioned on a starboard side of watercraft 100. Pontoon 102 is centrally positioned (and thus can be referred to as center pontoon 102) and is thus positioned substantially midway between pontoons 103, 104. In such a center location, pontoon 102 advantageously receives some buffering by, and thus protection by, pontoons 103, 104 in the event of a side collision to watercraft 100. Pontoon 102 is removably attached to underside 105. Each of pontoons 102, 103, 104 is configured to float. Pontoon 102 may optionally be referred to as an enclosure, because, as described below, pontoon 102 is configured to house in an interior 322 (FIG. 3) thereof a variety of structures, in accordance with the present invention. Pontoon 102 provides an enclosure for containing therein elements of a marine propulsion system 341 (FIG. 3), wherein marine propulsion system 341 is configured for providing propulsion through water when pontoon 102 is attached to underside 105 of deck 101 of watercraft 100. Further, advantageously the pontoon of the present invention (such as pontoon 102) can be configured for being universally attachable to virtually any deck of a pontoon boat so as to form the watercraft of the present invention.

Pontoon 102 includes a body 107 and a marine propulsion device 108 coupled (in any suitable manner) with body 107. Body 107 includes a main section 120 (here, formed as a tubular structure 120) and a front snout 121. Body 107, and thus pontoon 102, is hydrodynamically shaped so as to reduce drag through the water. Marine propulsion device 108 includes, according to one embodiment of the present invention, a sterndrive device 109 (which can also be referred to as an outdrive device 109) and a driveshaft 434 (FIG. 4) which transmits rotation from an electric motor 324 (FIG. 3)—which functions as an engine—to sterndrive device 109. Sterndrive device 109 includes propeller 110. Sterndrive device 109 can be deemed to be part of an inboard/outboard configuration, with sterndrive device 109 being located at least substantially outside of body 107 and electric motor 324 being located within body 107. Further, with sterndrive 109 being an outdrive and being located at the rear of center pontoon 102, sterndrive 109 provides buffering and thus some protection for remaining portions of pontoon 102 in the event of a rear end collision to watercraft 100.

Figure 2:
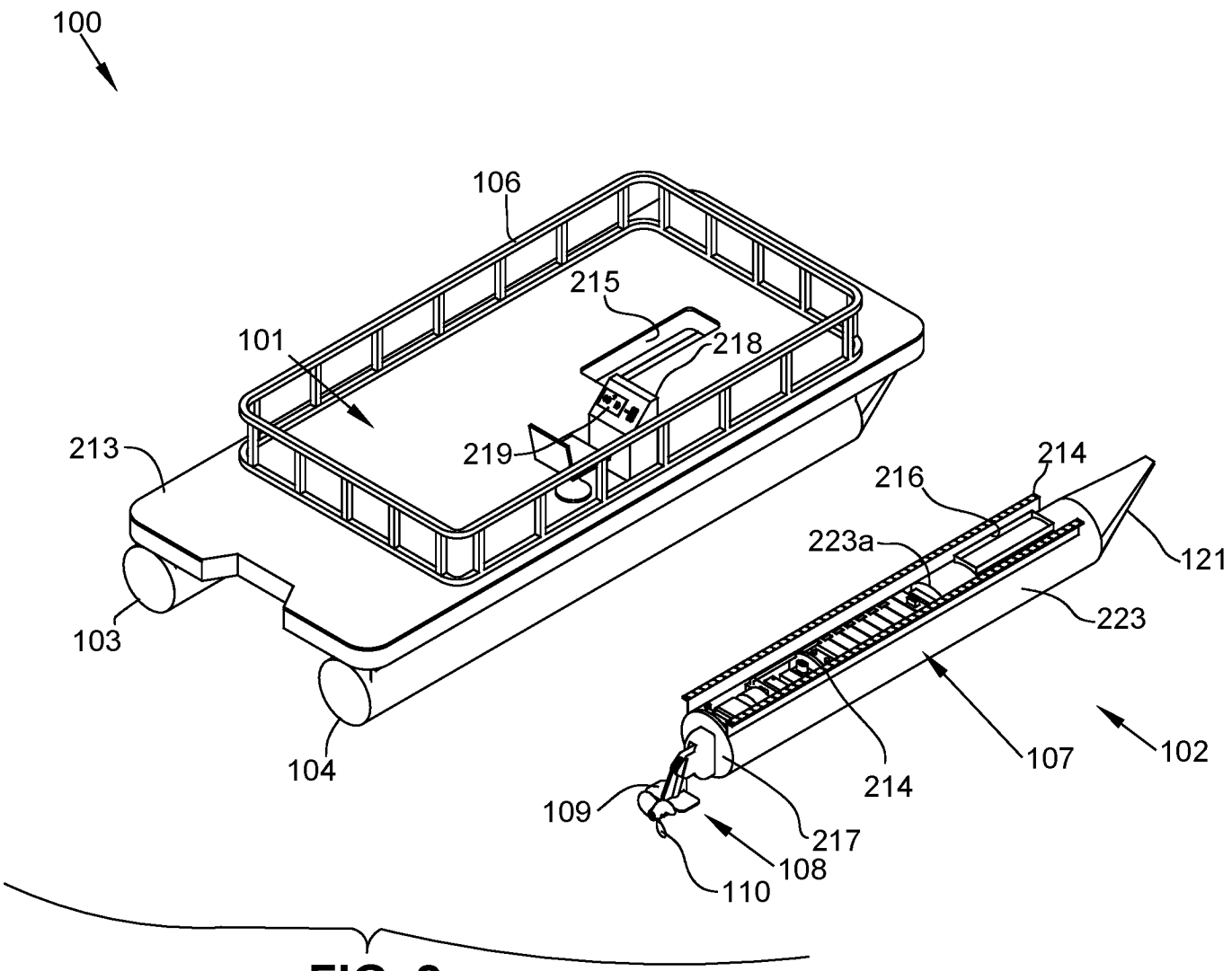
FIG. 2 illustrates an exploded, top perspective view of the watercraft of FIG. 1, in accordance with an exemplary embodiment of the present invention.

Further, as shown in FIG. 1, pontoon 102 includes a length, pontoon 103 includes a length, pontoon 104 includes a length, the length of pontoon 102 being less than the length of pontoon 103 and the length of pontoon 104 (the lengths of pontoons 103, 104 being substantially similar to one another). Further, deck 101 includes a length, the length of pontoon 102 being less than the length of deck 101. Further, pontoon 102 includes a rear portion 111, deck 101 includes a rear edge 112, and rear portion 111 of pontoon 102 is positioned forward of rear edge 112 of deck 101. Further, deck 101 can include a swimming platform 213 which includes rear edge 112 of deck 101 (FIG. 2). Thus, as shown in FIG. 1, advantageously propeller 110 is located forward of rear edge 112 of swimming platform 213. As such, this reduces the likelihood that swimmers will move to a position that is disadvantageously close to sterndrive device 109 and thus also propeller 110. Further, the location of the sterndrive device 109 advantageously allows improved maneuverability of watercraft 100. According to an alternative embodiment of the present invention, it can be appreciated that the lengths of pontoons 102, 103, and 104 can be equal to one another. Further, it can be appreciated that, according to an alternative embodiment of the present invention, the rear edge of the deck can be substantially straight across the entire way, rather than having a center cutout as shown in FIG. 1.

Referring now to FIG. 2, there is shown an exploded, top perspective view of watercraft 100. FIG. 2 shows deck 101 and swimming platform 213, which can be understood to form a part of deck 101; deck 101 is supported by pontoons 102, 103, 104. Deck 101 defines a hole 215, which is configured to be a through-hole 215 in deck 101. Hole 215 functions as a crush zone for deck 101. Further, hole 215 is positioned so as to be above a front portion 223 of pontoon 102; front portion 223 extends from a front tip of snout 121 to approximately end **223*a* just forward of structures 324, 325, 326, 327, 328, 329, 330, 331, and 332 (FIG. 3) stored within body 107 (these structures are discussed below). Front portion 223 can include a storage area or locker 216 (such as to store water skis), which can be accessed by a user via hole 215. Further, front portion 223 (or a portion thereof, including storage area 216) can be configured as a crush zone (which can be baffled) for pontoon 102, such that this crush zone is configured for mitigating damage or rupture to energy storage device 325 (such as a battery 325)(FIG. 3) resulting from a front end collision or head-on collision. Watercraft 100 further includes a helm 218, which includes operator controls and/or indicators 219. As indicated above, pontoon 102 is removably attachable to underside 105 of deck 101. Pontoon 102 includes upraised attachment arms 214 attached to body 107 (in any suitable manner, such as by fasteners, welding, and/or a slide-in connection), such that the removable attachability of pontoon 102 relative to deck 101 can be accomplished by way of attaching attachment arms 214 to underside 105 of deck 101 (and, optionally, swimming platform 213). In this way all elements of pontoon 102 can be positioned below an upper surface of deck 101 (see FIG. 6). The sterndrive device 109 is supported by body 107 and is attached to a rear wall 217 of body 107 of pontoon 102**, in a manner that is generally similar to a known way that a sterndrive device is attached to a transom of a marine vessel.

Figure 3:
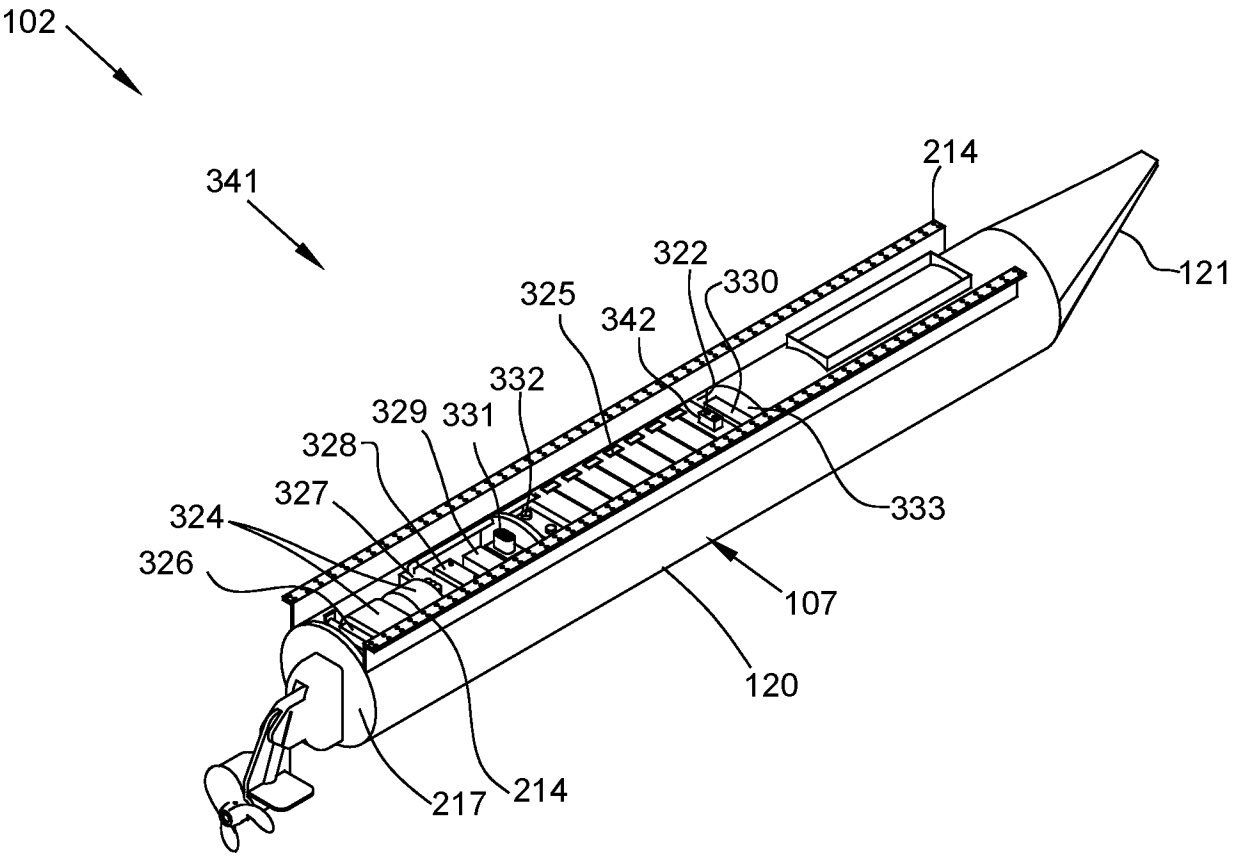
FIG. 3 illustrates a top perspective view of the center pontoon of FIG. 1, in accordance with an exemplary embodiment of the present invention.

Referring now to FIG. 3, there is shown a top perspective view of pontoon 102. Pontoon 102 includes body 107, which includes tubular section 120, snout 121, and rear wall 216 and defines an interior 322, which is defined at least in part by tubular section 120 and rear wall 216.

Pontoon 102 further includes each of the following, each of which can be completely positioned within (and thus disposed within) interior 322 and coupled with body 107 in any suitable manner: an electric motor and gearbox 324 (together the electric motor and the gearbox are referenced with a single reference number, though typically herein only the electric motor is explicitly mentioned with reference character 324), electric motor 324 being operably coupled with marine propulsion device 108; energy storage device 325 which is electrically coupled with electric motor 324, wherein energy storage device 325 can be formed as, for example, a high voltage storage battery for powering electric motor 324; an electric steering device 326 operably coupled with the marine propulsion device 108 and configured for directing thrust; an inverter 327, which is configured for converting direct current (DC) voltage to alternating current (AC) motor drive voltage; an electric motor controller 328; a converter 329, which is configured for converting a high DC voltage to a low DC voltage (12 to 48 volts), in order to power, for example, lights, a stereo, and other low voltage accessories of watercraft 100; a balance charging device 330, configured for charging high voltage battery 325; a high-voltage charge port 342; a helm interface electrical connector 331, configured for allowing any or all electrical aspects of pontoon 102 to be controlled, such as by way of input signals from helm 218, and for allowing any or all other electrical aspects of watercraft 100 apart from pontoon 102 to receive electrical power from pontoon 102, such as low voltage for status display(s) of helm 218 or elsewhere and other low voltage accessories; and an energy storage device 332, such as a low voltage storage battery, which is configured for electrically powering helm 218 of watercraft 100. With further reference to electrical connector 331, electrical connector 331 can be electrically coupled with helm 218, in order to power electrical steering of watercraft 100, throttle control of watercraft 100, status display(s), and low voltage accessories; further, electrical connector 331 (which can be a single electrical connector) can provide high current low voltage DC power from converter 329 to helm 218 for electrically powering lights, stereo, status display(s), and other accessories. High-voltage charge port 342 serves, and thus is configured, to power balance charging device 330, which can accept either 120V-240V AC or high voltage (400V-800V) DC. Body 107 further includes an upper portion 333 configured for allowing access to each of structures 324, 325, 326, 327, 328, 329, 330, 331, and 332 and thus extends in FIG. 3 from rear wall 217 to substantially where the lead line of reference character 333 touches.

Thus, it can be understood that watercraft 100 includes marine propulsion system 341. System 341 includes structures 108, 109, 110, 324, 325, 326, 327, 328, 329, 330, 331, 332, and 342. In this way, marine propulsion system 341 is detachable from deck 101 when pontoon 102 is detached from deck 101, such that pontoon 102 can be said to contain marine propulsion system 341.

According to an embodiment of watercraft 100, watercraft 100 can include one or more access doors (not shown, at least in full) located in a top surface of deck 101. Further, pontoon 102 can also include upper portion 333 which can be selectively covered by one or more access doors or panels (not shown), with at least certain parts of marine propulsion system 341 (those parts positioned within body 107) being positioned under such access panels. Such access doors in deck 101 and access panels of pontoon 102 allows user to easily access the engine compartment (that is, all the space within body 107 that stores therein any or all of marine propulsion system 341) from deck 101, so that routine maintenance and/or repair can be performed without removing pontoon 102 from its attachment position under deck 101. The access panels of pontoon 102 can be rubber sealed access panels covering or enclosing those parts of marine propulsion system 341 disposed within body 107, so as to seal those parts off from any water incursion.

According to an embodiment of the present invention, body 107 can have a rounded top surface, over at least portions of a top portion of pontoon 102. On the other hand, the top surface of body 107 can be a flat plane, so as to facilitate mounting of pontoon 102 to underside 105 of deck 101.

Figure 4:
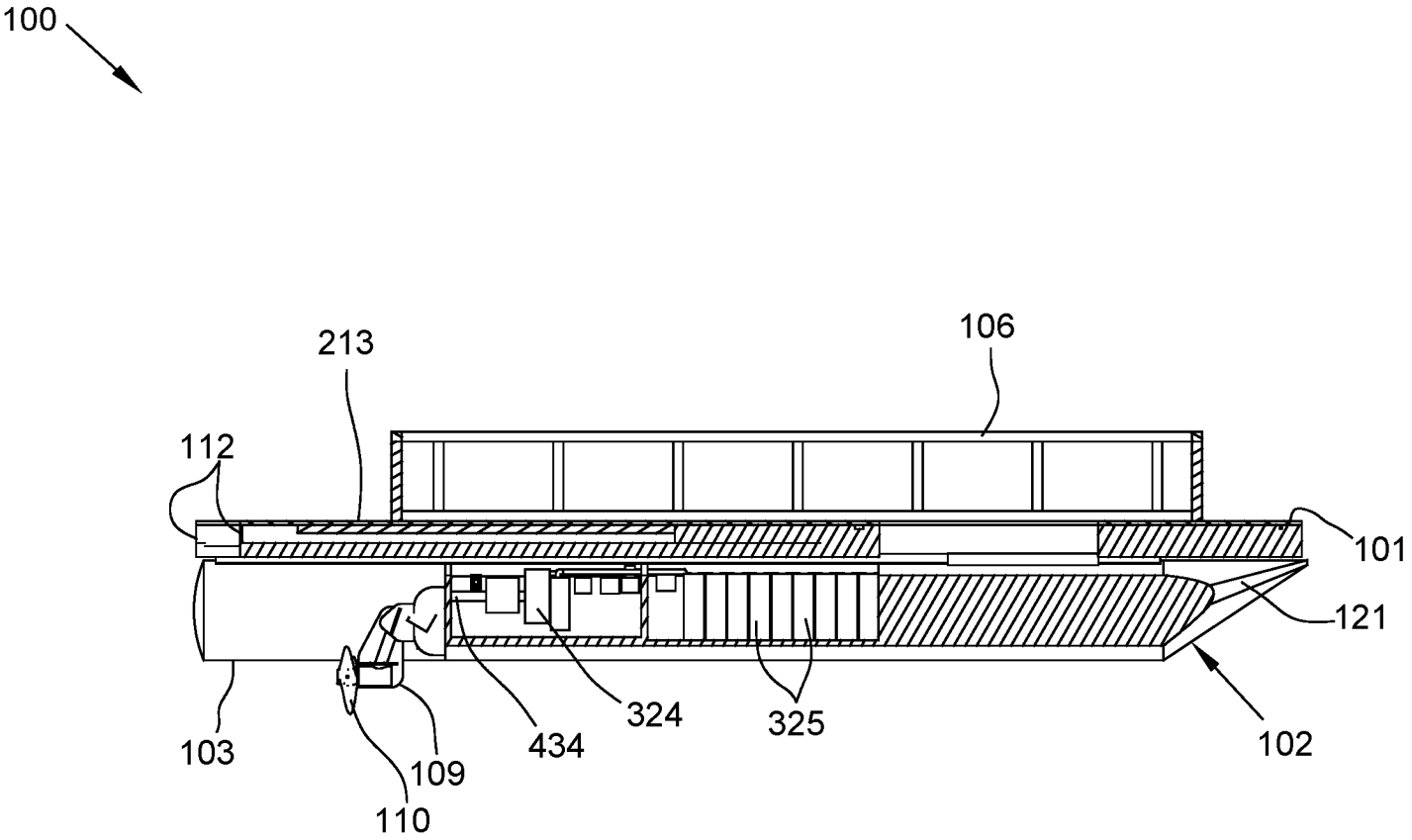
FIG. 4 illustrates a side cross-sectional view of the watercraft of FIG. 1, taken along line 4-4 in FIG. 1, in accordance with an exemplary embodiment of the present invention.

Referring now to FIG. 4, there is shown a side cross-sectional view of watercraft 100, taken along line 4-4 in FIG. 1. Pontoon 102 is shown to include, for example, electric motor 324, energy storage device 325 (a plurality thereof), driveshaft 434, sterndrive 109, and propeller 110. This side view shows that propeller 110 is forward of, and thus spatially separated from, rear edge 112 of deck 101 (more specifically, of swimming platform 213 of deck 101). This spatial separation decreases the likelihood that a swimmer at the rear of watercraft 100 will move to a position that is dangerously close to propeller 110.

Figure 5:
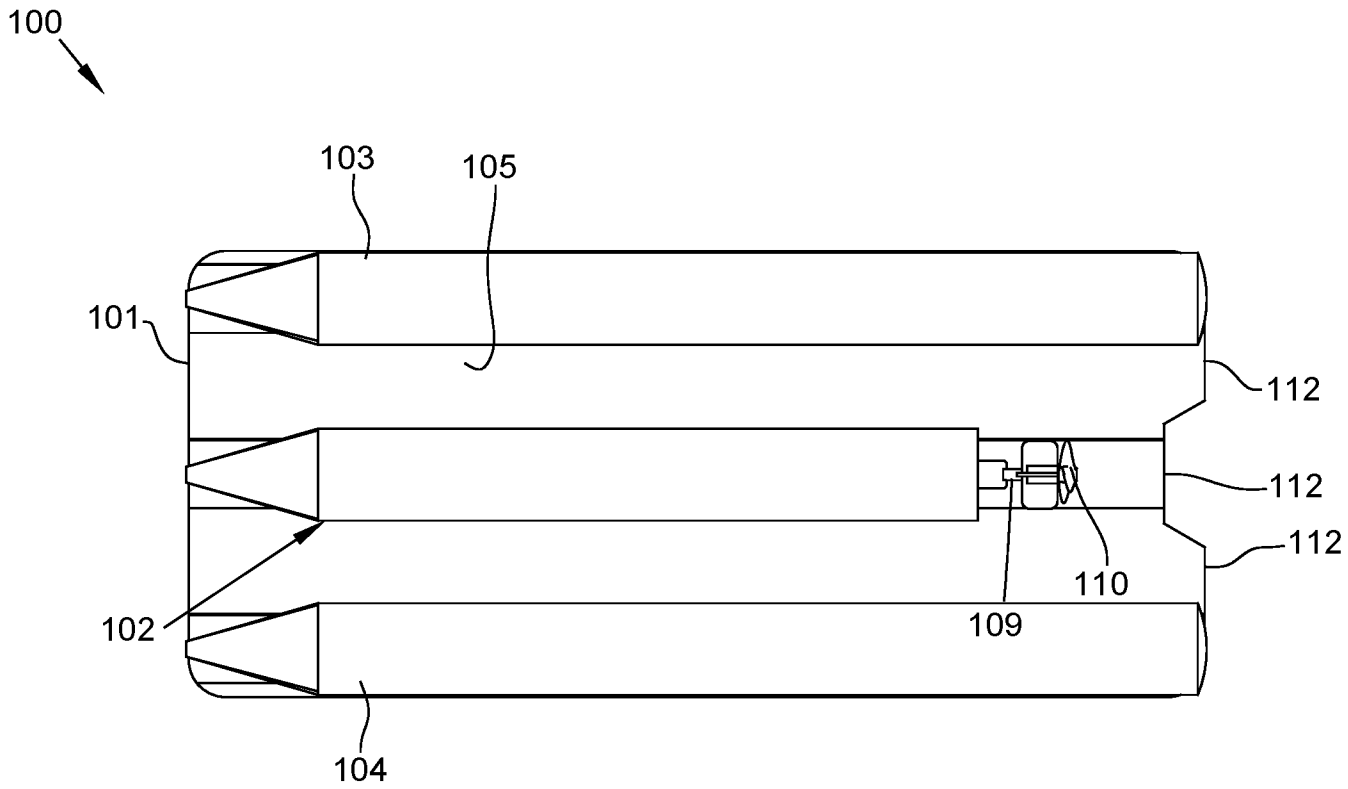
FIG. 5 illustrates a bottom view of the watercraft, in accordance with an exemplary embodiment of the present invention.

Referring now to FIG. 5, there is shown a bottom view of watercraft 100. Shown are underside 105 of deck 101 and pontoons 102, 103, 104, as well as sterndrive device 109 and propeller 110. Further, FIG. 5 shows the position of propeller 110 relative to rear edge 112.

Figure 6:
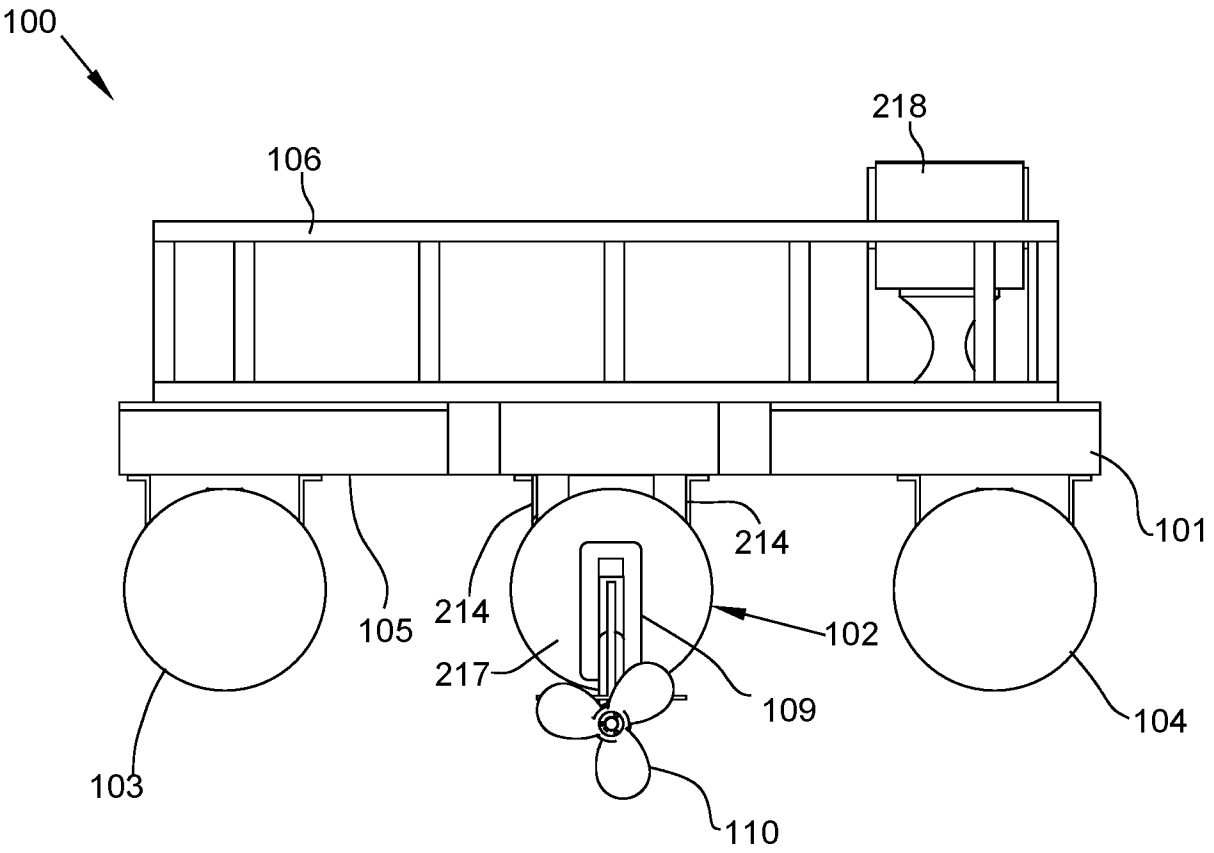
FIG. 6 illustrates a rear view of the watercraft of FIG. 1, in accordance with an exemplary embodiment of the present invention.

Referring now to FIG. 6, there is shown a rear view of watercraft 100. Shown are deck 101 and pontoons 102, 103, 104. Attachment arms 214 are shown attaching the remainder of pontoon 102 to deck 101.

Further, with respect to an embodiment of the present invention that incorporates a sterndrive device (such as watercraft 100 with sterndrive device 109) with a container (such as pontoon 102), all of the container and the sterndrive device is able to be located below a top surface of the deck (deck 101).

Figure 7:
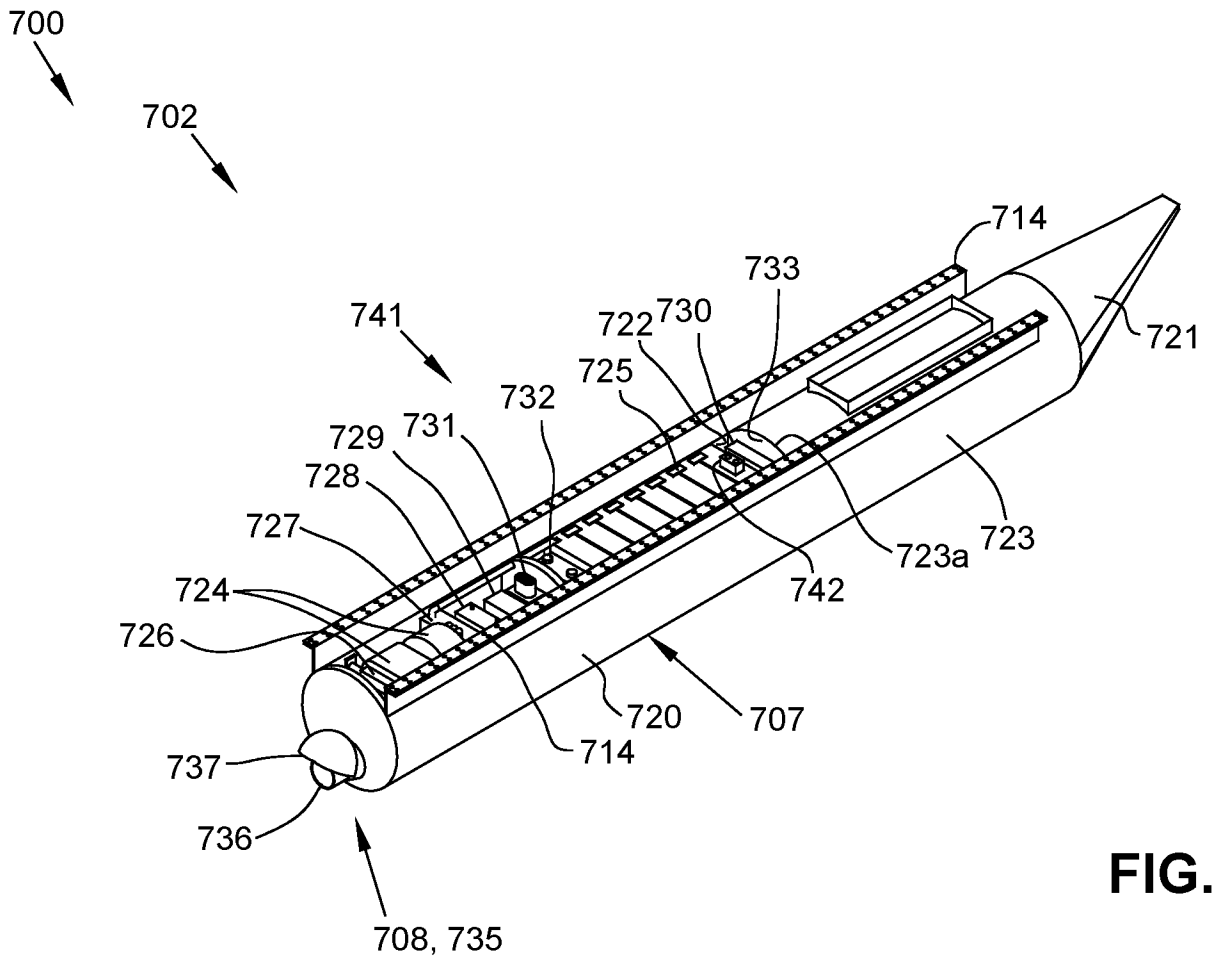
FIG. 7 illustrates a top perspective view of another embodiment of the center pontoon, in accordance with an exemplary embodiment of the present invention.

Referring now to FIG. 7, there is shown a top perspective view of another embodiment of the center pontoon of the watercraft of the present invention, with portions broken away, according to an exemplary embodiment of the present invention. The watercraft and center pontoon of FIG. 7 are labeled 700 and 702, respectively. Many prior reference numbers with respect to watercraft 700 are increased by a multiple of 100 and thus are substantially similar to the structures and function described and shown with respect to watercraft 100, unless otherwise shown and/or described differently. The primary difference between watercraft 100 and watercraft 700 is with respect to the center pontoon, and the primary difference between center pontoon 102 and center pontoon 702 concerns the marine propulsion device. Whereas center pontoon 102 includes marine propulsion device 108 with sterndrive device 109, pontoon 702 includes marine propulsion device 708 that includes a jet drive 735 in place of the sterndrive device 109. Jet drive 735 is driven by electric motor 724 and includes nozzle 736 and reverse gate 737. Jet drive 735 can further include an impeller (not shown) that is driven by a drive shaft (not shown), which itself is driven by electric motor 724, wherein the impeller and the drive shaft are housed within body 707 of pontoon 702. Jet drive 735 is dirigible. Thus, it can be understood that watercraft 700 includes a marine propulsion system 741, which includes structures 708, 735, 736, 737, as well as 724, 725, 726, 727, 728, 729, 730, 731, 732, and 742.

Figure 8:
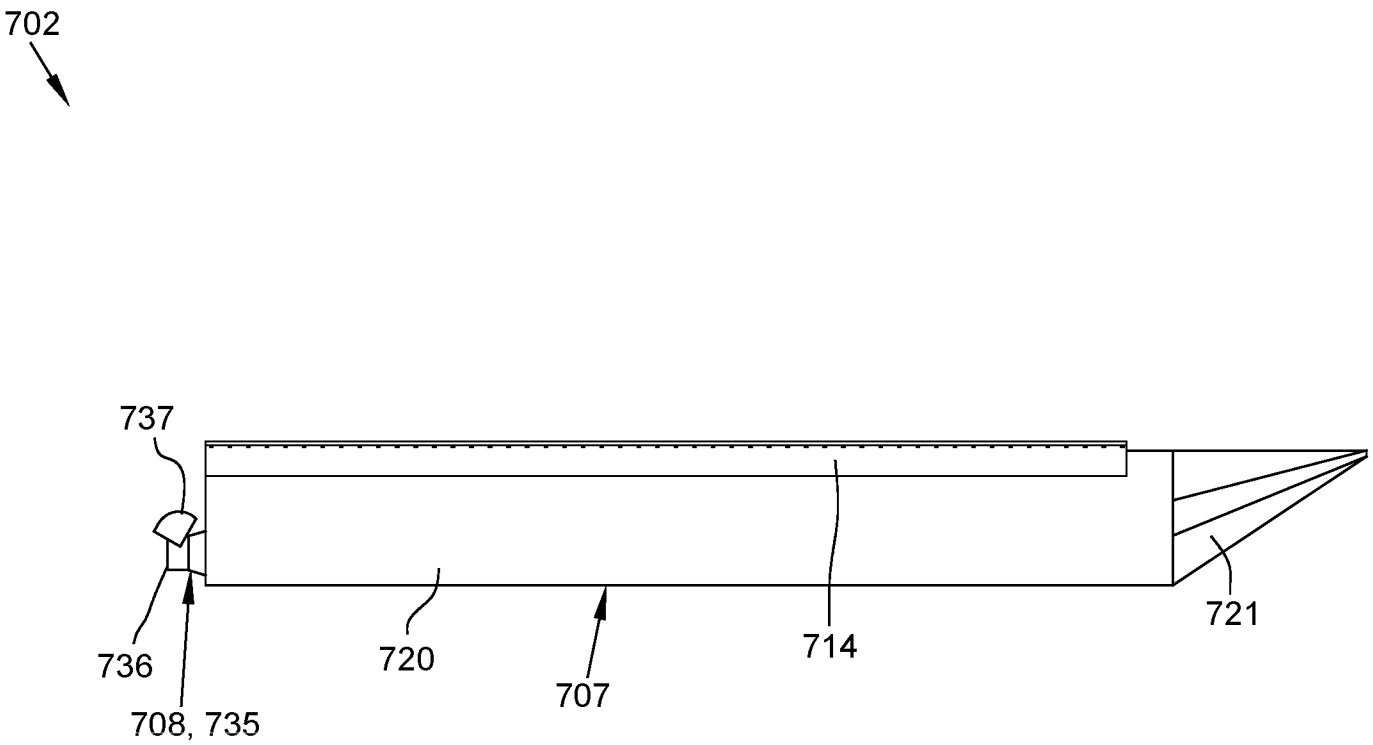
FIG. 8 illustrates a side view of the pontoon of FIG. 7, in accordance with an exemplary embodiment of the present invention.

Referring now to FIG. 8, there is shown a side view of ponton 702. Shown are body 707, attachment arms 714, and jet drive 735.

Further, with respect to watercraft 700 employing jet drive device 735, nozzle 736 is dirigible and allows jet drive device 735 to be steered without having to move the engine (that is, electric motor 724) relative to watercraft 700. In addition, by locating electric motor 724 within body 707 of pontoon 702 which is removably attached to the underside of the deck, nozzle 736 and reverse gate 737 of jet drive device 735 can be moved considerably forward from the rear edge of the deck.

In this way, jet drive device 735 is rotatable relative to electric motor 724, which drives the impeller of jet drive device 735.

This, however, is not the case in prior art devices wherein an outboard motor is equipped with a jet drive attached to the bottom portion of its driveshaft housing. In that type of known system, the engine of the outboard motor must be rotated about a steering axis, and the jet drive itself does not rotate relative to that engine but rotates with the engine and the other components of the outboard motor about the steering axis. The present invention advantageously avoids this.

Figure 9:
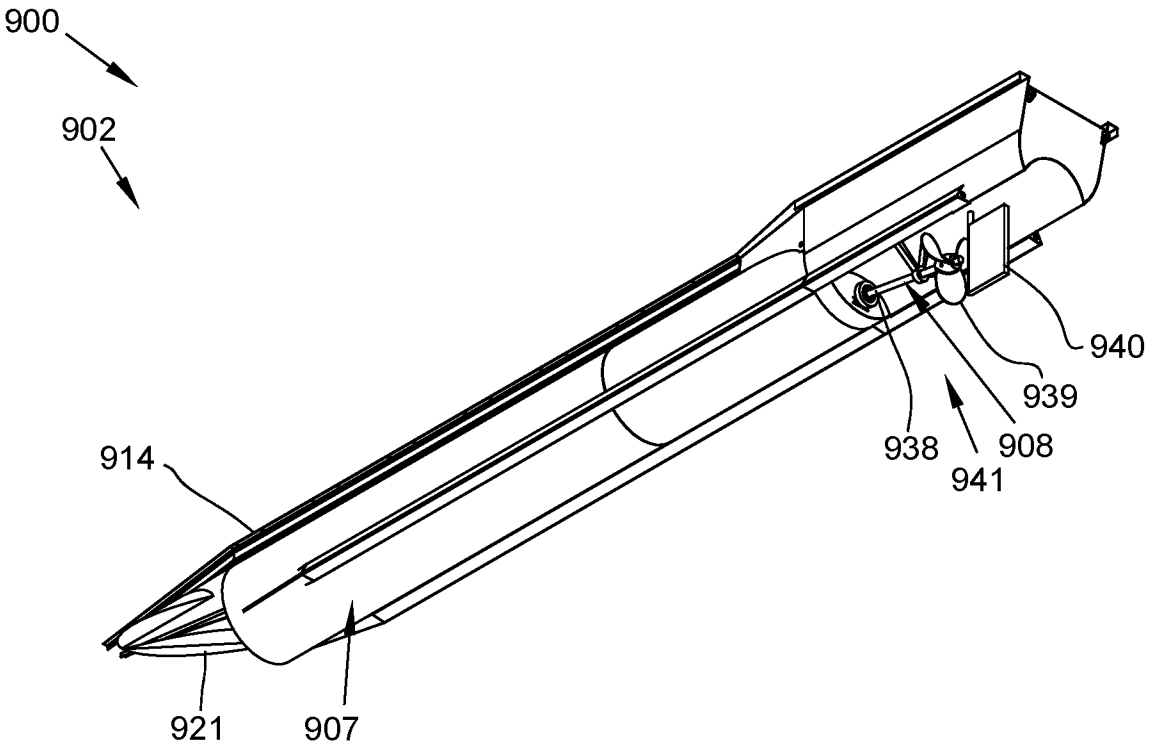
FIG. 9 illustrates a bottom perspective view of yet another embodiment of a center pontoon, in accordance with an exemplary embodiment of the present invention.

Referring now to FIG. 9, there is shown a bottom perspective view of yet another embodiment of the center pontoon of the watercraft of the present invention, with portions broken away, according to an exemplary embodiment of the present invention. The watercraft and center pontoon of FIG. 9 are labeled 900 and 902, respectively. Many prior reference numbers with respect to watercraft 900 are increased by a multiple of 100 and thus are substantially similar to the structures and function described and shown with respect to watercraft 100, unless otherwise shown and/or described differently. The primary difference between watercraft 100 and watercraft 900 is with respect to the center pontoon, and one substantial difference between center pontoon 102 and center pontoon 902 concerns the marine propulsion device. Whereas center pontoon 102 includes marine propulsion device 108 with sterndrive device 109, pontoon 902 includes marine propulsion device 908 that includes a direct drive propulsion device 908, which includes a direct drive propeller shaft 938 and a propeller 939. Shaft 938 is driven by electric motor 324 of pontoon 902. Further, direct drive propulsion device 908 can be said to further include a steering rudder 940 (for directed thrust) coupled with body 907, rudder 940 being electrically controlled. Thus, it can be understood that watercraft 900 includes a marine propulsion system 941, which includes structures 908, 938, 939, 940, as well as 324, 325, 326, 327, 328, 329, 330, 331, 332, and 342. Marine propulsion system 908 can be understood to provide a directed drive inboard implementation.

Figure 10:
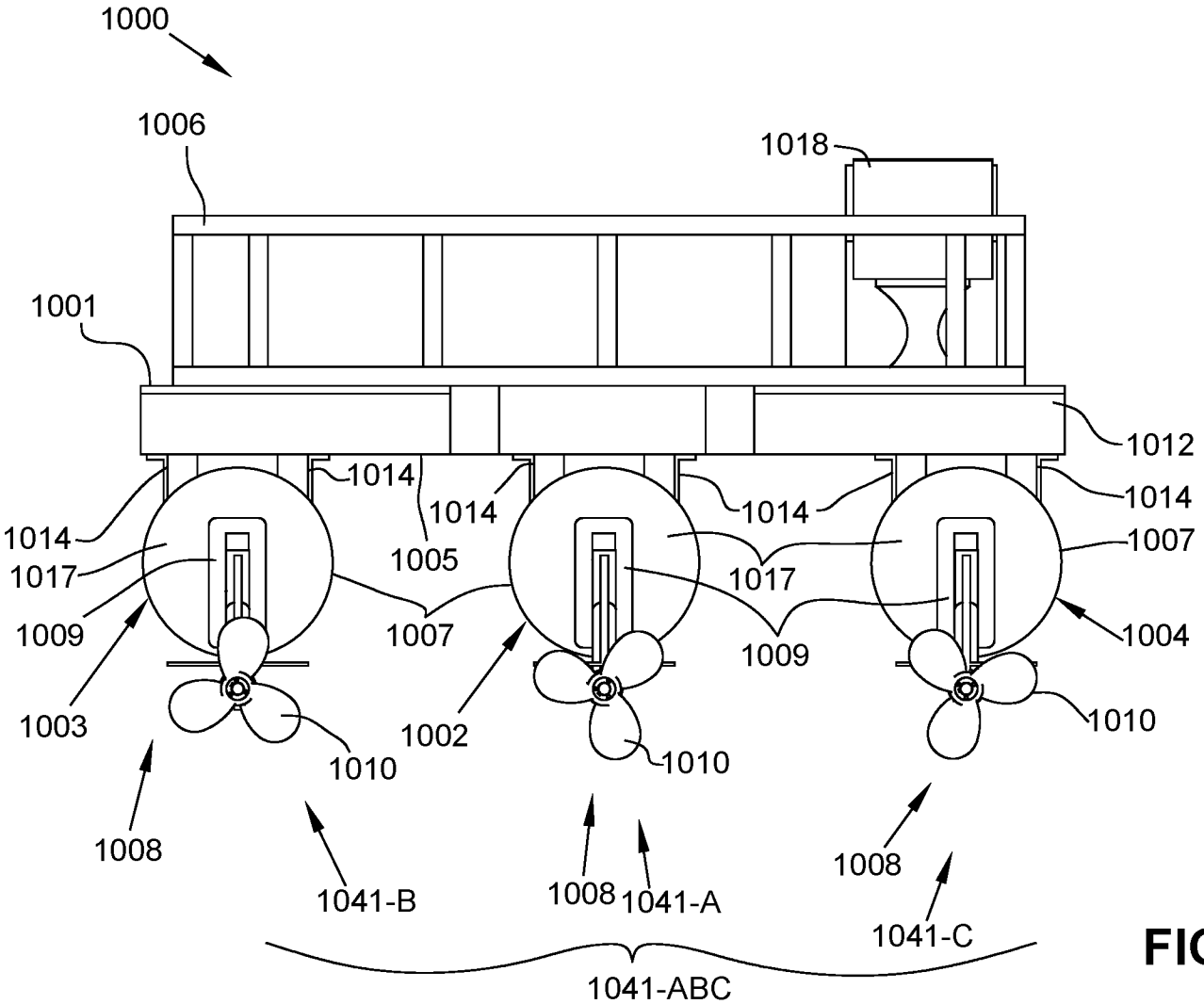
FIG. 10 illustrates a rear view of yet another embodiment of a watercraft, in accordance with an exemplary embodiment of the present invention.

Referring now to FIG. 10, there is shown a rear view of yet another embodiment of the watercraft of the present invention, according to an exemplary embodiment of the present invention. The watercraft of FIG. 10 is labeled 1000. Many prior reference numbers with respect to watercraft 1000 are increased by a multiple of 100 and thus are substantially similar to the structures and function described and shown with respect to watercraft 100, unless otherwise shown and/or described differently. The primary difference between watercraft 100 and watercraft 1000 is with respect to port and starboard pontoons 103, 104. Center pontoon 1002 is substantially similar to center pontoon 102. But, in FIG. 10, port and starboard pontoons 1003, 1004 are more like center pontoon 1002 than are pontoons 103, 104 relative to center pontoon 102. More specifically, pontoons 1003, 1004 are substantially similar to center pontoon 1002 (which includes the lengths of pontoons 1002, 1003, 1004 being substantially equal to one another); thus, it can be understood that pontoons 1003, 1004 replace pontoons 103, 104, which can optionally occur in a retrofit operation of a watercraft. Thus, it can be appreciated that watercraft 1000 includes a marine propulsion system 1041-ABC, which is a combination of marine propulsion systems 1041-A, 1041-B, 1041-C, wherein each of marine propulsion systems 1041-A, 1041-B, 1041-C are substantially similar to marine propulsion system 341. Pontoon 1002 includes marine propulsion system 1041-A, pontoon 1003 includes marine propulsion system 1041-B, and pontoon 1004 includes marine propulsion system 1041-C. In this way, watercraft 1000 utilizes a triple motor configuration for additional thrust. Further, it can be appreciated that such a triple motor configuration can employ other ways of creating motive power, such as that shown and/or described with respect to FIGS. 7 and 9.

Accordingly, watercraft 1000 includes: (A) pontoon 1003 coupled with deck 1001, pontoon 1003 including: body 1007; marine propulsion device 1008; and electric motor 324 operably coupled with marine propulsion device 1008 and disposed within the body 1007; and (B) a pontoon 1004 coupled with deck 1001, pontoon 1004 including: a body 1007; a marine propulsion device 1008; and an electric motor 324 operably coupled with marine propulsion device 1008 and disposed within body 1007, wherein the pontoons 1003, 1004 are each laterally positioned, and pontoon 1003 is a center pontoon and thus positioned between pontoons 1003, 1004.

Figure 11:
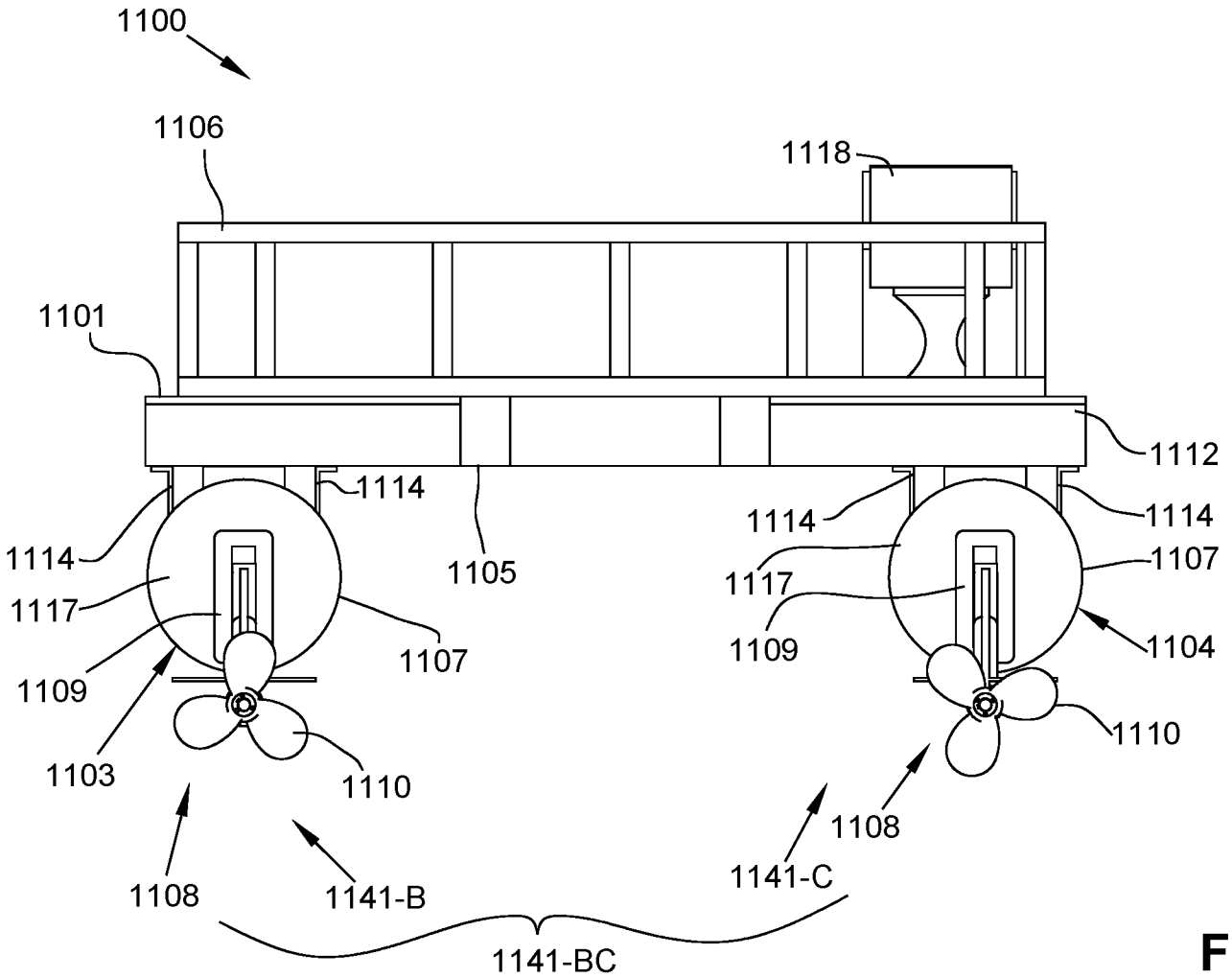
FIG. 11 illustrates a rear view of yet another embodiment of a watercraft, in accordance with an exemplary embodiment of the present invention.

Referring now to FIG. 11, there is shown a rear view of yet another embodiment of the watercraft of the present invention, according to an exemplary embodiment of the present invention. The watercraft of FIG. 10 is labeled 1100. Many prior reference numbers with respect to watercraft 1100 are increased by a multiple of 100 and thus are substantially similar to the structures and function described and shown with respect to watercraft 100, unless otherwise shown and/or described differently. The primary difference between watercraft 100 is best understood with respect to watercraft 1000; that is, watercraft 1100 includes pontoons 1003, 1004 (now labeled 1103, 1104) but omits center pontoon 1002 altogether. Thus, pontoons 1103, 1104 are substantially similar to pontoons 1003, 1004. In this way, watercraft 1100 utilizes a dual motor configuration for additional thrust. Further, it can be appreciated that such a dual motor configuration can employ other ways of creating motive power, such as that shown and/or described with respect to FIGS. 7 and 9. Thus, it can be understood that pontoons 1103, 1104 replace pontoons 103, 104, which can optionally occur in a retrofit operation of a watercraft.

Accordingly, watercraft 1100 includes: (A) pontoon 1003 coupled with deck 1101, pontoon 1103 including: body 1107; marine propulsion device 1108; and electric motor 324 operably coupled with marine propulsion device 1108 and disposed within the body 1107; and (B) a pontoon 1104 coupled with deck 1101, pontoon 1104 including: a body 1107; a marine propulsion device 1108; and an electric motor 324 operably coupled with marine propulsion device 1108 and disposed within body 1107, wherein the pontoons 1103, 1104 are each laterally positioned.

Sterndrive device 109, jet drive device 735, and/or direct drive propulsion device 908 can be configured so as to have the ability to trim and steer electrically.

During manufacture of the center pontoon, the marine propulsion system, as well as all of the center pontoon 102, can be completely fabricated at a site which is remote from the remainder of watercraft itself. The completed center pontoon, with its electric motor and marine propulsion device (for example), can then be delivered and attached as a completed unit to the underside of the deck of the watercraft. The center pontoon is removably attached to the deck of the watercraft so that the center pontoon can be removed, for example, for purposes of repair and other maintenance procedures. The center pontoon is intended to be removably attached to the underside of the deck of the watercraft, optionally at a location which places the actual propulsor, such as a propeller or an impeller, forward of a rear portion of the deck.

In use, pontoons 102, 702, 902, 1002, 1003, 1004, 1103, 1104 can be formed prior to mounting them to an underside of the deck 101, 1001, 1101 of the watercraft 100, 700, 900, 1000, 1100. In so doing, all pertinent portions of marine propulsion systems 341, 741, 1041-ABC, 1141-BC are housed within body 107, 707, 907, 1007, 1107, with pertinent portions of marine propulsion devices 107, 07, 907, 1007, 1107 being mounted externally to body 107, 707, 907, 1007, 1107. Pontoons 102, 702, 902, 1002, 1003, 1004, 1103, 1104 can then be mounted to deck 101, 1001, 1101.

Figure 12:
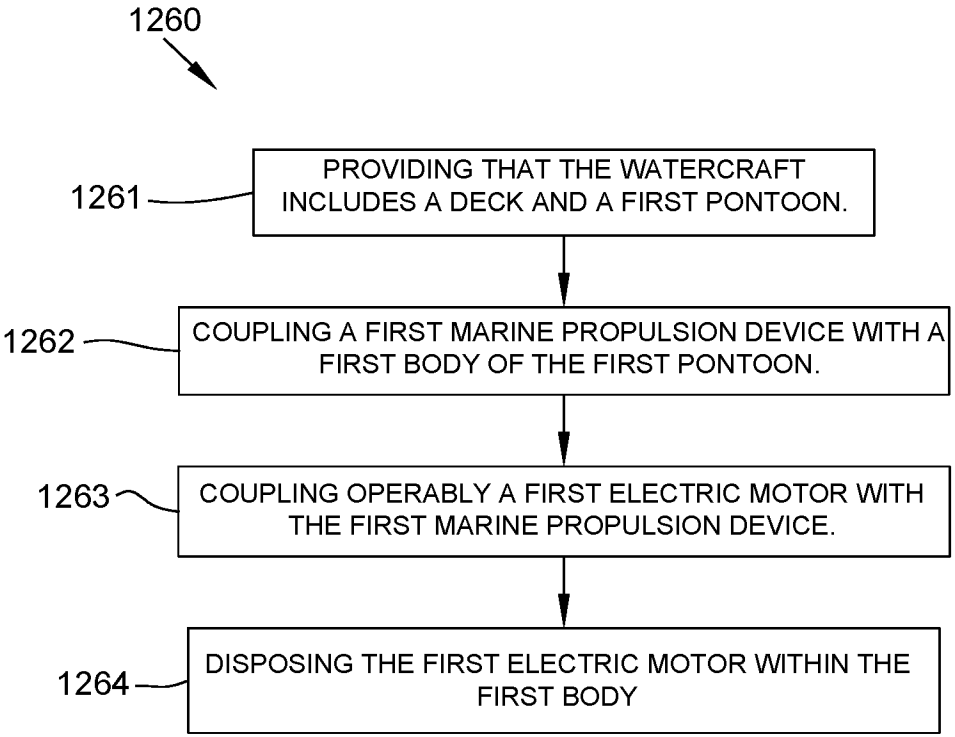
FIG. 12 illustrates a flow diagram showing a method of using the watercraft, in accordance with an exemplary embodiment of the present invention.

Referring now to FIG. 12, there is shown a flow diagram showing a method 1260 of using watercraft 100, 700, 900, 1000, 1100. Method 1260 includes the steps of: providing 1261 that the watercraft 100, 700, 900, 1000, 1100 includes a deck 101, 1001, 1101 and a first pontoon 102, 702, 902, 1002, 1103 coupled with the deck 101, 1001, 1101, the first pontoon 102, 702, 902, 1002, 1103 including a first body 107, 707, 907, 1007, 1107; coupling 1262 a first marine propulsion device 108, 708, 1008, 1108 with the first body 107, 707, 907, 1007, 1107; coupling 1263 operably a first electric motor 324, 724 with the first marine propulsion device 108, 708, 1008, 1108; and disposing 1264 the first electric motor within the first body 107, 707, 907, 1007, 1107. Further, watercraft 100, 700, 900, 1000 can further include a second pontoon 103, 1003 and a third pontoon 104, 1004 each of which is laterally positioned, the first pontoon 102, 702, 902, 1002 being a center pontoon and thus positioned between the second pontoon 103, 1003 and the third pontoon 104, 1004. Further, deck 101, 1001 can include an underside 105, 1005, the first pontoon 102, 702, 902, 1002 being removably attached to the underside 105, 1005. Further, watercraft 100, 700, 900, 1000 can further include a first energy storage device 325, 725 electrically coupled with the first electric motor 324, 724 and disposed within the first body 107, 707, 907, 1007. Further, first marine propulsion device 108, 708, 1008 includes: a sterndrive device 109; a direct drive propeller shaft 938 and a propeller 939, the first pontoon 902 further including a steering rudder 940 coupled with the first body 907; or a jet drive 735. Further, it can be that: (a) the first pontoon 102, 702, 902, 1002 includes a first length, the second pontoon 103, 1003 includes a second length, the third pontoon 104, 1004 includes a third length, the first length being less than each of the second length and the third length; and (b) the deck 101, 1001 includes a deck length, the first length being less than the deck length, the first pontoon 102, 702, 902, 1002 including a rear portion 111, and the deck 101, 1001 including a rear edge 112, 1012, the rear portion 111 of the first pontoon 102, 702, 902, 1002 being positioned forward of the rear edge 112, 1012 of the deck 101, 1001. Further, first pontoon 102, 702, 902, 1002 can further include: a first energy storage device 325, 725 operably coupled with the first electric motor 324, 724 and disposed within the first body 107, 707, 907, 1007; a gearbox 324, 724 disposed within the first body 107, 707, 907, 1007; an electric steering device 326, 726 disposed within the first body 107, 707, 907, 1007 and operably coupled with the first marine propulsion device 108, 708, 1008; an inverter 327, 727 disposed within the first body 107, 707, 907, 1007; an electric motor controller 328, 728 disposed within the first body 107, 707, 907, 1007; a converter 329, 729 disposed within the first body 107, 707, 907, 1007; a balance charging device 330, 730 disposed within the first body 107, 707, 907, 1007; a second energy storage device 332, 732 configured for electrically powering a helm 218, 1018 of the watercraft 100, 700, 900, 1000 and disposed within the first body 107, 707, 907, 1007, wherein the first pontoon 102, 702, 902, 1002 includes a front portion 223, 723 which includes a crush zone configured for mitigating a damage resulting from a front end collision. Further, it can be that: (a) the watercraft 1100 further includes: a second pontoon 1104 coupled with the deck 1101, the second pontoon 1104 including: a second body 1107; a second marine propulsion device 1108; and a second electric motor 324 operably coupled with the second marine propulsion device 1108 and disposed within the second body 1107, wherein the first pontoon 1103 and the second pontoon 1104 are each laterally positioned; or (b) the watercraft 1000 further includes: a second pontoon 1003 coupled with the deck 1007, the second pontoon 1003 including: a second body 1007; a second marine propulsion device 1008; and a second electric motor 324 operably coupled with the second marine propulsion device 1008 and disposed within the second body 1007; and a third pontoon 1004 coupled with the deck, the third pontoon 1004 including: a third body 1007; a third marine propulsion device 1008; and a third electric motor 324 operably coupled with the third marine propulsion device 1008 and disposed within the third body 1007, wherein the second pontoon 1003 and the third pontoon 1004 are each laterally positioned, and the first pontoon 1002 is a center pontoon and thus positioned between the second pontoon 1003 and the third pontoon 1004.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A watercraft, comprising:

a deck; and a first pontoon coupled with the deck, the first pontoon including:

a first body;

a first marine propulsion device coupled with the first body; and a first electric motor operably coupled with the first marine propulsion device and disposed within the first body, the first marine propulsion device being a jet drive that includes an impeller disposed within the first body, a driveshaft operably coupling the impeller with the first electric motor, a nozzle that is configured for being dirigible and for being directionally controlled independent of a rotation of the first electric motor, and a reverse gate coupled with the nozzle.

2. The watercraft of claim 1, further comprising a second pontoon and a third pontoon each of which is laterally positioned, the first pontoon being a center pontoon and thus positioned between the second pontoon and the third pontoon.

3. The watercraft of claim 2, wherein the deck includes an underside, the first pontoon being removably attached to the underside.

4. The watercraft of claim 3, further comprising a first energy storage device electrically coupled with the first electric motor and disposed within the first body.

5. The watercraft of claim 4, wherein:

(a) the first pontoon includes a first length, the second pontoon includes a second length, the third pontoon includes a third length, the first length being less than each of the second length and the third length; and (b) the deck includes a deck length, the first length being less than the deck length, the first pontoon including a rear portion, and the deck including a rear edge, the rear portion of the first pontoon being positioned forward of the rear edge of the deck, the impeller and the nozzle being positioned entirely forward of the rear edge of the deck.

6. The watercraft of claim 4, wherein the first pontoon further includes:

a first energy storage device operably coupled with the first electric motor and disposed within the first body;

a gearbox disposed within the first body;

an electric steering device disposed within the first body and operably coupled with the first marine propulsion device;

an inverter disposed within the first body;

an electric motor controller disposed within the first body;

a converter disposed within the first body;

a balance charging device disposed within the first body;

a second energy storage device configured for electrically powering a helm of the watercraft and disposed within the first body, wherein the first pontoon includes a front portion which includes a crush zone configured for mitigating a damage resulting from a front end collision, the front portion including a storage area that is positioned forward of the first electric motor, the crush zone being baffled and including the storage area.

7. The watercraft of claim 1, wherein:

(a) the watercraft further includes:

a second pontoon coupled with the deck, the second pontoon including:

a second body;

a second marine propulsion device; and a second electric motor operably coupled with the second marine propulsion device and disposed within the second body, wherein the first pontoon and the second pontoon are each laterally positioned; or (b) the watercraft further includes:

a second pontoon coupled with the deck, the second pontoon including:

a second body;

a second marine propulsion device; and a second electric motor operably coupled with the second marine propulsion device and disposed within the second body; and a third pontoon coupled with the deck, the third pontoon including:

a third body;

a third marine propulsion device; and a third electric motor operably coupled with the third marine propulsion device and disposed within the third body, wherein the second pontoon and the third pontoon are each laterally positioned, and the first pontoon is a center pontoon and thus positioned between the second pontoon and the third pontoon.

8. A pontoon of a watercraft, the watercraft including a deck with which the pontoon is coupled, the pontoon comprising:

a body;

a marine propulsion device coupled with the body; and an electric motor operably coupled with the marine propulsion device and disposed within the body, the first marine propulsion device being a jet drive that includes an impeller disposed within the first body, a driveshaft operably coupling the impeller with the first electric motor, a nozzle that is configured for being dirigible and for being directionally controlled independent of a rotation of the first electric motor, and a reverse gate coupled with the nozzle.

9. The pontoon of claim 8, wherein the pontoon is configured for being removably attached to an underside of the deck, the pontoon further comprising an energy storage device electrically coupled with the electric motor and disposed within the body.

10. The pontoon of claim 8, further comprising:

a first energy storage device operably coupled with the first electric motor and disposed within the first body;

a gearbox disposed within the first body;

an electric steering device disposed within the first body and operably coupled with the first marine propulsion device;

an inverter disposed within the first body;

an electric motor controller disposed within the first body;

a converter disposed within the first body;

a balance charging device disposed within the first body;

a second energy storage device configured for electrically powering a helm of the watercraft and disposed within the first body, wherein the first pontoon includes a front portion which includes a crush zone configured for mitigating a damage resulting from a front end collision, the front portion including a storage area that is positioned forward of the first electric motor, the crush zone being baffled and including the storage area.

11. A method using a watercraft, the method comprising the steps of:

providing that the watercraft includes a deck and a first pontoon coupled with the deck, the first pontoon including a first body;

coupling a first marine propulsion device with the first body;

coupling operably a first electric motor with the first marine propulsion device; and disposing the first electric motor within the first body, the first marine propulsion device being a jet drive that includes an impeller disposed within the first body, a driveshaft operably coupling the impeller with the first electric motor, a nozzle that is configured for being dirigible and for being directionally controlled independent of a rotation of the first electric motor, and a reverse gate coupled with the nozzle.

12. The method of claim 11, wherein the watercraft further includes a second pontoon and a third pontoon each of which is laterally positioned, the first pontoon being a center pontoon and thus positioned between the second pontoon and the third pontoon.

13. The method of claim 12, wherein the deck includes an underside, the first pontoon being removably attached to the underside.

14. The method of claim 13, wherein the watercraft further includes a first energy storage device electrically coupled with the first electric motor and disposed within the first body.

15. The method of claim 14, wherein:

(a) the first pontoon includes a first length, the second pontoon includes a second length, the third pontoon includes a third length, the first length being less than each of the second length and the third length; and (b) the deck includes a deck length, the first length being less than the deck length, the first pontoon including a rear portion, and the deck including a rear edge, the rear portion of the first pontoon being positioned forward of the rear edge of the deck, the impeller and the nozzle being positioned entirely forward of the rear edge of the deck.

16. The method of claim 14, wherein the first pontoon further includes: a first energy storage device operably coupled with the first electric motor and disposed within the first body; a gearbox disposed within the first body; an electric steering device disposed within the first body and operably coupled with the first marine propulsion device; an inverter disposed within the first body; an electric motor controller disposed within the first body; a converter disposed within the first body; a balance charging device disposed within the first body; a second energy storage device configured for electrically powering a helm of the watercraft and disposed within the first body, wherein the first pontoon includes a front portion which includes a crush zone configured for mitigating a damage resulting from a front end collision, the front portion including a storage area that is positioned forward of the first electric motor, the crush zone being baffled and including the storage area.

17. The method of claim 11, wherein:

(a) the watercraft further includes:

a second pontoon coupled with the deck, the second pontoon including:

a second body;

a second marine propulsion device; and a second electric motor operably coupled with the second marine propulsion device and disposed within the second body, wherein the first pontoon and the second pontoon are each laterally positioned; or (b) the watercraft further includes:

a second pontoon coupled with the deck, the second pontoon including:

a second body;

a second marine propulsion device; and a second electric motor operably coupled with the second marine propulsion device and disposed within the second body; and a third pontoon coupled with the deck, the third pontoon including:

a third body;

a third marine propulsion device; and a third electric motor operably coupled with the third marine propulsion device and disposed within the third body, wherein the second pontoon and the third pontoon are each laterally positioned, and the first pontoon is a center pontoon and thus positioned between the second pontoon and the third pontoon.

* * * * *